United States Patent [19]

Beyer

[11] 4,106,578

[45] Aug. 15, 1978

[54] PERCUSSION DRILL BIT

[76] Inventor: Leaman Rex Beyer, Box 207, Diamond, Mo. 64840

[21] Appl. No.: 683,095

[22] Filed: May 4, 1976

[51] Int. Cl.[2] ..... E21B 9/22

[52] U.S. Cl. ..... 175/407; 175/410

[58] Field of Search ..... 175/406, 407, 408, 409, 175/401, 418, 414, 415, 410

[56] References Cited

U.S. PATENT DOCUMENTS

| | | | |
|---|---|---|---|
| 2,958,513 | 11/1960 | Bennett | 175/407 |
| 3,071,201 | 1/1963 | Phipps | 175/410 |
| 3,346,060 | 10/1967 | Beyer | 175/410 |
| 3,915,246 | 10/1975 | Sheshtawy | 175/410 |

*Primary Examiner*—Ernest R. Purser
*Assistant Examiner*—Richard E. Favreau

[57] ABSTRACT

A rotary air percussion drill bit which has a cylindrical body portion with first and second ends. A flat bottom face comprises one end with a shaft attached to the remaining end. A plurality of hard inserts is mounted in the body portion and projects downwardly from both the body portion and from the flat bottom face. The rotary air percussion drill bit has a first chip clearance means formed into the body portion longitudinally along its side wall with a second chip clearance formed around the side wall intermediate the first and second ends. The improvement in the rotary air percussion drill bit provides for a vertical slot which cuts through the drill base down the drill body and forms an arcuate terminus tapered to the cylindrical wall to the drill bit. A gauge tooth is mounted in the arcuate terminus at approximately 20° to 35° with a line normal to the axis of the drill bit. An additional improvement comprises an obtuse angle chip clearance storage region which is disposed between the first and second set of gauge teeth and is formed by a deep cut into the side of the drill bit and around the periphery of the drill bit. The side walls of the cut form an obtuse angle having a short side facing downwardly toward the flat face of the drill bit and a long side tapering up toward the first set of gauge teeth. A second set of gauge teeth is mounted around the short side of the chip clearance storage region. Opposite the short side is a second beveled edge which provides additional chip clearance. Both beveled edges protect the body of the drill against wear, thereby providing longer support to the carbide or hard inserts and extending thereby the life of the drill bit.

3 Claims, 4 Drawing Figures

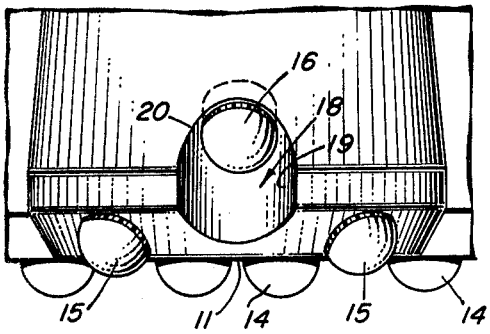
FIG. 2
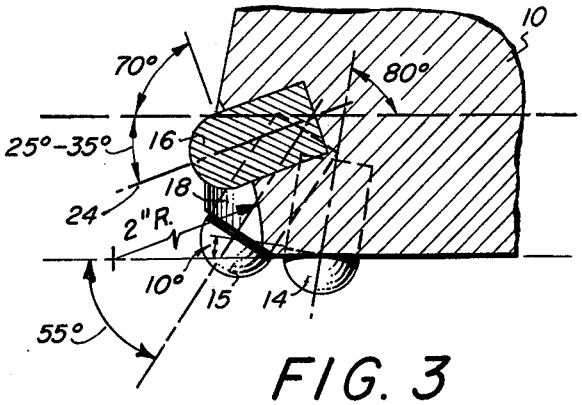
FIG. 3
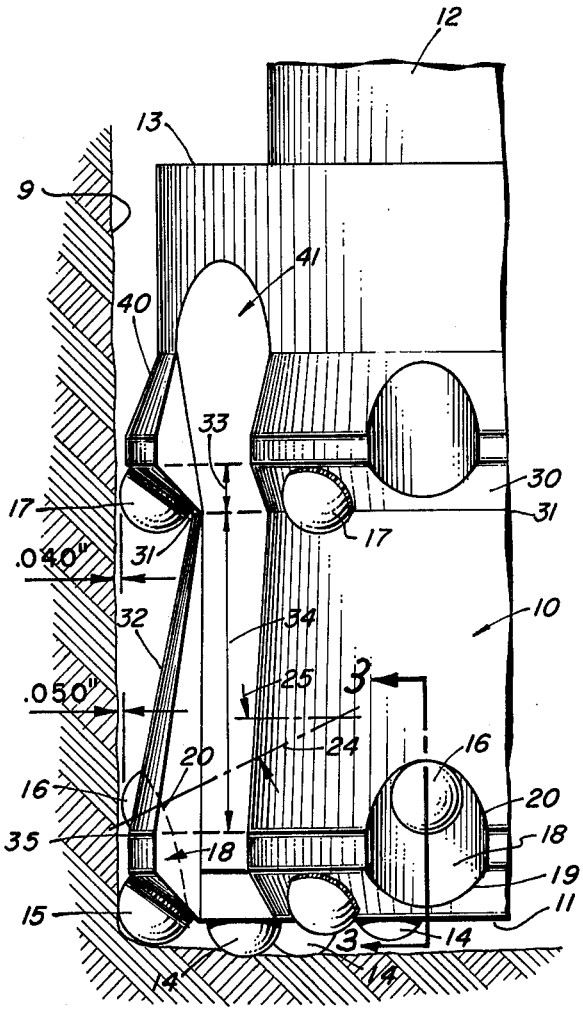
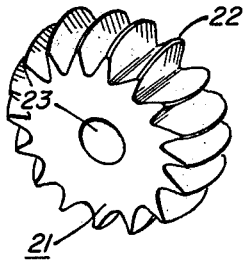
FIG. 4
FIG. 1

PERCUSSION DRILL BIT

BRIEF DESCRIPTION OF THE PRIOR ART

The best prior art known to the inventor is the patent previously issued to this inventor, U.S. Pat. No. 3,346,060, on Oct. 10, 1967, entitled "Rotary-Air-Percussion, Stabilizer and Reemer Drill Bit of Its Own True Gauge." This drill bit contains a cylindrical body portion and has a plurality of circumferential grooves. Gauge inserts are mounted in the grooves and facing downwardly toward the flat surface at the bottom of the drill. The drill also contains vertical chip clearance slots which assist in removing the chip as they accumulate during the drilling process, however, one problem with this drill bit is the accumulation of material underneath the drill and around the circumferential grooves which contain the gauge inserts. The accumulation of this material causes wear on the body of the drill and therefore loss of support around and under the carbide inserts which provide the cutting surfaces for the drill bit and provide gauge control as the cutting is being performed.

BRIEF DESCRIPTION OF THE INVENTION

This invention provides for support of the gauge inserts and provides for a chip storage region between the flat face and the second set of gauge teeth. Additional chip storage regions can be provided if additional gauge teeth are provided for the drill.

In order to provide a chip clearance region, an obtuse angle is formed into the side wall of the drill bit between the surface supporting the gauge carbide teeth and the first set of gauge teeth on the flat face of the drill bit. This obtuse angle provides a large volume chip storage region which provides for the accumulation of chips during the cutting process and thereby provides adequate time for the chips to be removed instead of causing the chips to be compacted adjacent the support surface for the gauge teeth. Such compaction would result in wearing away of the body surface of the drill, causing a loss in metal support to the gauge carbides and thereby substantial reduction of the life of the drill.

An additional feature of this invention is the mounting of the first row of gauge carbide teeth. The mounting comprises a vertical slot cut through the flat face of the drill and into the side wall of the drill. The slot is arcuate and terminates in the arcuate contour from the bottom of the slot to the terminus of the slot at the cylindrical side wall of the cutter bit. Gauge carbides are mounted in the arcuate terminus of the slot at approximately a 25° to a 35° angle with respect to a line which is normal to the axis of the drill bit. When the insert is mounted in this arcuate portion, an increased support wall is furnished around the gauge insert carbides, thereby providing a substantial increase in strength to the gauge insert carbides. This increase in the metal around the carbides provides for an increase life of the drill, since wear normally tends to erode away the body of the drill thereby causing lack of support which will, in turn, cause the insert to either drop off or fracture. The mounting surface containing the gauge teeth is immediately tapered toward the axis of the drill bit to provide adequate relief for the chips seeking to escape from the drilling area. The beveled edge, formed by the aforementioned taper, provides chip relief which also results in an increase in the life of the drill.

All of the changes incorporated above causes a substantial increase in life of the drill and thereby a substantial reduction in the cost of drilling the average bore hole when a percussion bit is used.

BRIEF DESCRIPTION OF THE FIGURES

FIG. 1 illustrates a drill bit incorporating the features of this invention as it would appear in cutting position in a bore hole;

FIG. 2 is a view taken 90° to FIG. 1 of the lower portion of FIG. 1;

FIG. 3 is taken through the lines 3—3 of FIG. 1; and

FIG. 4 is a perspective view of a cutter used to cut the insert mounting slot.

DETAILED DESCRIPTION OF THE INVENTION

This invention can be best described by referring to FIGS. 1 through 3 wherein a drill body 10 has a flat bottom face 11 at one end and a drill shank 12, a portion of which is illustrated in FIG. 1, attached to the remaining end 13. Face 11 has a plurality of hard inserts 14.

A plurality of hard inserts 14 is rigidly secured into the face 11 of drill body 10. This is normally accomplished by drilling a cylindrical hole into the drill face having a size slightly smaller (for example 0.003 inches) than the insert and then pressing or hammering insert 14 into the hole. Teeth 15 provide not only a drilling function but also set the diameter or gauge of bore hole 9. The gauge is maintained in the hole by means of two sets of gauge teeth, the first set comprising teeth 16 and the second set comprising teeth 17. Each set of teeth is disposed at intervals around the periphery of the drill body 10 in a manner to be described.

The mounting of teeth 16 is accomplished by forming an elongated slot 18 Slot 18 has arcuate side walls 19 and an arcuate terminus 20. The elongated slot 18 may be cut by a milling cutter 21 illustrated in FIG. 4. Cutter 21 has a plurality of curved teeth 22 disposed around its outer periphery. The cutter 21 is rotated about an axis 23, and teeth 22 are forced against the drill body 10 cutting the slot 18. The arcuate slot 18 can either be formed by merely rotating milling cutter 21 or by moving milling cutter 21 longitudinally as well as rotating milling cutter 21 about axis 23. It is obvious that these slots can also be formed by forging or molding. Once the slot is formed, a hole is drilled along a line 24 (FIG. 1) which has an angle 25 which may be, for example, from 25° to 35°. The preferred angle for a 6-inch bit is 35°.

Referring specifically to FIG. 3, the preferred radius of elongated cut 18 is 2 inches for milling cutter 21. It is obvious, of course, that other radii can be used and still be within the spirit and scope of the invention, so long as adequate support is given to the underside of gauge insert 16.

In order to provide for chip storage during the cutting process and thereby enhance and increase the life of the drill bit, reference should be made to FIG. 1 where a beveled surface 30 is utilized to mount the second set of gauge teeth 17. This beveled edge is approximately 45° but can be from 35° to 50° with the outer cylindrical surface of the drill bit and is cut to a depth depending upon the total diameter of the drill bit. In a 6-inch drill bit the depth 31 is cut approximately ½ inch or one-twelfth of the distance of the diameter. An obtuse angled sloping wall 32 begins at the bottom of cut 31 and tapers gradually to the cylindrical wall just behind gauge insert carbides 15 and at a point 35. The distance between 31 and 32 is substantial. As an example, the distance 33, which is the distance subtended by bevel 30, and distance 34, which is the distance subtended by obtuse angle 32, is approximately 1 to 5 but can be as small as 1 to 4. Using the above ratio, an adequate amount of chip storage will be provided between the first set of gauge teeth 15 and 16 and the second set of gauge teeth 17. A distinct advantage is afforded when the chip storage is provided in this region. For example, as chips accumulate without adequate storage provided, the chips will begin to compress and cause wear against any surface where the chips can be compacted. Such surfaces are along sloping wall or beveled edge 32, beveled surface 30, which supports gauge teeth 17, etc. Wear on these points of the drill body will cause erosion of the body material from around the inserted teeth. Once this support is lost, the tooth can become either dislodged or be easily fractured. Sloping side 40 to body 10 provides additional chip removal. Slot 41, which is well known in the art, provides chip removal from face 11.

It is obvious that modifications and changes can be made in the drill bit improvements described in the preceding specification without departing from the spirit and scope of the invention as clearly described in both the specification and the appended claims.

What I claim is:

1. In a rotary percussion drill bit having a cylindrical body portion having first and second ends with a flat bottom and a bevel face on one end and a shank axially aligned with said cylindrical portion on said other end, a first set of inserts of hard wear resistant material mounted in said body portion and projecting downwardly from said flat bottom and said bevel face, said body portion having a longitudinal groove means formed in said cylindrical body portion to provide a passage for dislodged chips and a peripheral groove means for passage of dislodged chips, said peripheral groove means formed around said cylindrical body portion intermediate said first and second ends, and at least a second set of inserts of wear resistant material spaced from said first set of inserts of wear resistant material mounted in said cylindrical body portion, an improvement comprising a peripheral chip storage groove means formed at the location of said peripheral groove means said peripheral chip storage groove means having a crossectional configuration of an obtuse angle when taken along the axis of said cylindrical body portion, said peripheral chip storage groove means having a maximum depth equal to or greater than 1/12 the diameter of said drill bit and having the side walls of said peripheral chip storage groove means tapered to form an obtuse angle from its deepest point toward said first and second set of inserts of wear resistant material, and therein said peripheral chip storage groove means give more storage for drill cuttings.

2. A bit as described in claim 1, wherein an arcuate slot is formed vertically into said cylindrical side wall and arcuately tapering outwardly to the outer circumference of said cylindrical body portion at a location intermediate said first and second ends, a cylindrically shaped insert receiving means formed normal to and in said arcuately tapered portion of said slot wherein the axis of said cylindrically shaped insert receiving means is oriented at an angle of between 25 and 35 degrees with respect to a line normal to the axis of said cylindrical body portion, and an insert means rigidly secured into said cylindrically shaped insert receiving means, whereby additional body support will be provided to said insert means.

3. A drill bit as described in claim 1 wherein said second set of inserts of wear resistant material are mounted on one portion of said peripheral chip storage groove means extending from said maximum depth to said first set of inserts of wear resistant material and has a said length which subtends a portion of the axis equal to or greater than four times the length of the axis subtended by the said one portion.

* * * * *